United States Patent [19]

Staniszewski

[11] Patent Number: 4,576,493

[45] Date of Patent: Mar. 18, 1986

[54] LOCKING ASSEMBLY FOR PRINT WHEEL

[75] Inventor: Tadeusz Staniszewski, Budd Lake, N.J.

[73] Assignee: Ziyad Incorporated, Denville, N.J.

[21] Appl. No.: 534,128

[22] Filed: Sep. 20, 1983

[51] Int. Cl.[4] ..... B41J 1/60

[52] U.S. Cl. ..... 400/175; 400/355

[58] Field of Search ..... 400/144.2, 144.3, 149, 400/175, 692, 171, 355, 356

[56] References Cited

U.S. PATENT DOCUMENTS

| | | | |
|---|---|---|---|
| 3,878,929 | 4/1975 | Orlens et al. | 400/175 |
| 3,983,985 | 10/1976 | Guerrini et al. | 400/144.2 |
| 3,986,593 | 10/1976 | Orlens et al. | 400/144.2 |
| 3,991,873 | 11/1976 | Paulson | 101/93.19 X |
| 4,018,639 | 4/1977 | Staples, Jr. | 400/144.2 |
| 4,026,403 | 5/1977 | Inose et al. | 400/144.2 |
| 4,036,348 | 7/1977 | Guerrini | 400/144.2 |
| 4,049,109 | 9/1977 | Plaza et al. | 400/144.2 X |
| 4,049,110 | 9/1977 | Frechette | 400/144.2 |
| 4,127,335 | 11/1978 | Bogert et al. | 400/144.2 |
| 4,161,373 | 7/1979 | Chvatlinsky | 400/144.2 X |
| 4,178,107 | 12/1979 | Guerrini et al. | 400/144.2 |
| 4,202,639 | 5/1980 | Rello | 400/144.2 |
| 4,209,262 | 6/1980 | Savage | 400/144.2 |
| 4,299,502 | 11/1981 | Harre | 400/144.2 |
| 4,314,770 | 2/1982 | Harre | 400/175 |
| 4,386,864 | 6/1983 | Wang et al. | 400/144.2 X |

FOREIGN PATENT DOCUMENTS

| | | | |
|---|---|---|---|
| 199907 | 10/1978 | Fed. Rep. of Germany | 400/175 |
| 58740 | 12/1937 | Norway | 400/175 |

*Primary Examiner*—Edgar S. Burr
*Assistant Examiner*—John A. Weresh
*Attorney, Agent, or Firm*—Lerner,David,Littenberg, Krumholz & Mentlik

[57] ABSTRACT

A locking assembly is disclosed for mounting a print wheel of the daisy type to a rotary drive mechanism. The locking assembly is constructed of a print wheel stop rotatable with the shaft of the drive mechanism, a print wheel retainer slidable along the shaft between a print wheel connecting and attaching position and biasing means for biasing the print wheel retainer into the connecting and attaching positions. The print wheel is provided with attaching members for engaging a portion of the print wheel retainer while being supported by the print wheel stop for detachably connecting the print wheel thereto and for permitting detachment of the print wheel therefrom when the print wheel retainer is arranged by the biasing means into the detaching position. Further in accordance with the present invention there is provided a carriage assembly adapted for tilting the print wheel to facilitate replacement and/or removal thereof wherein the carriage assembly is provided with a bias plate. The bias plate is adapted to return the carriage assembly to its operating position after being tilted away therefrom upon initial operation of the printing device.

6 Claims, 9 Drawing Figures

FIG. 6
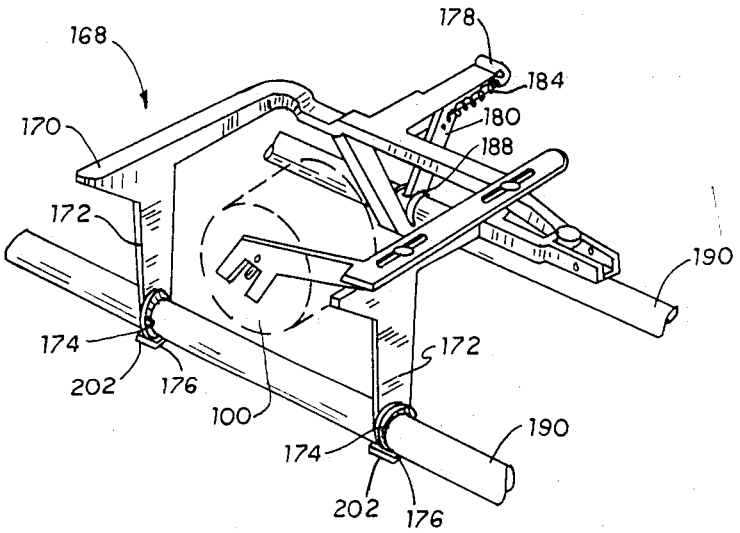
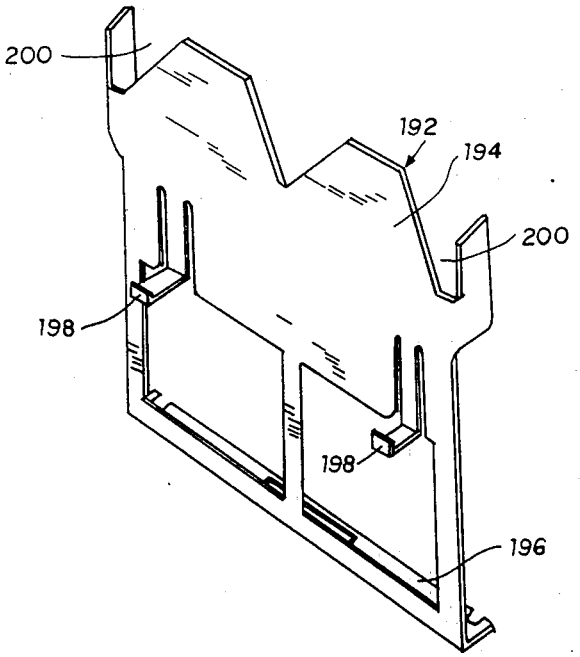
FIG. 7

LOCKING ASSEMBLY FOR PRINT WHEEL

BACKGROUND OF THE INVENTION

The present invention relates in general to a locking assembly for a print wheel and, more particularly, to an assembly adapted for detachably connecting a print wheel of the daisy type to a motor shaft of a printing device having means for advancing a sheet of paper past the print wheel to effect printing thereon. The assembly is arranged within a carriage for tilting the print wheel away from the advancing means for replacement of the print wheel while returning to its position adjacent the advancing means during operation of the printing device.

A print wheel of the daisy type is generally constructed of a central hub which is removably coupled to the motor shaft of the driving mechanism for the print wheel and includes a plurality of pedals or radially extending spokes which carry the various character elements at its radial extremities in circumferentially spaced positions about the print wheel. Print wheels or daisies of this type may be utilized in a variety of applications. For example, print wheels may be used in series printers which are associated with communication terminals, computer output devices and other printing applications in the data processing field.

One important consideration in mounting a print wheel of the daisy type is the manner in which the print wheel may be removed from the rotary drive mechanism. Removability and/replacement of the print wheel is particularly important since the print wheel is subjected to a substantial battering force by the hammer of the printing device. In addition, it is desirable, particularly in typewriter applications, to permit removability or replacement of the print wheel so as to allow for selection of a particular style or type by merely changing print wheels. Thus, the ability to rapidly change the print wheel provides the same printing device with a full range of typing capabilities, for example, mathematical type notations, symbols and the like.

In accordance with the prior art, there is disclosed in U.S. Pat. No. 4,314,770 a detachable connection assembly for removably securing a print wheel to a rotary drive mechanism. The prior art assembly is generally constructed of a free floating plate spring biased adjacent a flange which is secured to a motor shaft of a rotary drive mechanism. The print wheel is provided with an upper hook-shaped shoulder and a pair of lower hook-shaped shoulders arranged in triangular relationship for engaging the lateral edges of the free floating plate. In this regard, as the plate is biased towards the flange, the print wheel is secured to the assembly by compressing the hook-shaped shoulders between the free floating plate and the flange. Such prior art assembly suffers from a number of notable disadvantages inherent in its construction. Specifically, it is highly desirable that the print wheel be connected directly to the motor shaft to promote direct rotation of the print wheel so as to prevent intermittent slipping which would otherwise cause intermittent misalignment of the various character elements with the paper to be printed on. In this regard, the prior art assembly does not achieve such results due to the print wheel being secured to a free floating plate.

Accordingly, it can be appreciated that there is an unsolved need for a locking assembly for a print wheel of the daisy type which facilitates the removability and/or replacement thereof in connection with a motor shaft of a rotary drive mechanism.

SUMMARY OF THE INVENTION

It is broadly an object of the present invention to provide a locking assembly for a print wheel constructed and arranged in a manner which overcomes or avoids one or more of the foregoing disadvantages resulting from the use of the above-mentioned prior art assembly and, which fulfills the specific requirements of such a locking assembly for a print wheel of the daisy type and the like as noted herein. Specifically, it is within the contemplation of one aspect of the present invention to provide a locking assembly for a print wheel which permits removability and/or replacement thereof in a simple, quick and efficient manner.

The further object of the present invention is to provide a locking assembly for a print wheel which prevents any slippage thereof during rotation about its axis to prevent misalignment between the character elements and the paper to be printed upon.

A still further object of the present invention is to provide a locking assembly for a print wheel adapted to be tilted to facilitate removal and/or replacement thereof while returning to its operative position upon operation of the printing device.

In accordance with one embodiment of the present invention, there is provided an assembly adapted for detachably connecting a print element to a motor shaft. The assembly is constructed of a print element stop rotatable with the motor shaft and having a portion adapted for supporting the print element thereon, and a print element retainer movable along the motor shaft between a print element connecting position biased away from the stop and a print element detaching position biased towards the stop. The print element retainer includes means for engaging the print wheel to urge the print wheel into engagement with the stop for rotation therewith when the retainer is arranged in the connecting position and for permitting detachment of the print element therefrom when the retainer is arranged in the detaching position.

In accordance with the above embodiment, there is further provided a collar secured to the shaft to limit the extent of the permissible movement of the retainer along the shaft and a yoke having an opening adapted to receive the collar therethrough when the collar is arranged in alignment with the opening. The yoke is arranged for movement along the longitudinal axis of the shaft for engaging and moving the retainer along the shaft to the detaching position biased towards the stop when the collar is arranged in alignment with the opening of the yoke.

Further in accordance with the above embodiment, there is provided a pair of spaced apart pins arranged extending outwardly from the retainer for receiving therebetween a pin projecting outwardly from the yoke to hold the retainer in alignment wherein the opening of the yoke receives the collar therethrough.

Still further in accordance with the above embodiment, the stop is constructed from a hub secured to the free end of the shaft and having a plurality of outwardly extending members arranged in a plane normal to the longitudinal axis of the shaft, and further including an alignment member arranged on the print element and adapted to be received between a pair of outwardly extending members of the stop when the print element is connected thereto.

In accordance with another aspect of the present invention, there is provided a carriage assembly including a print element for use in a printing device, the printing device having advancing means for advancing a sheet of paper past the carriage assembly to effect printing thereon by the print element. The carriage assembly is constructed of support means for supporting the print element adjacent the advancing means, the support means being arranged within the printing device for tilting the print element away from the advancing means for replacement thereof, and biasing means in operative association with the printing device for biasing the support means towards the advancing means when the print element is tilted away from the advancing means and when the printing device is operated, to thereby cause the print element to return to a position adjacent the advancing means to effect printing on a sheet of paper.

BRIEF DESCRIPTION OF THE DRAWINGS

The above description, as well as further objects, features and advantages of the present invention will be more fully understood by reference to the following detailed description of a presently preferred, but nonetheless illustrative locking assembly for a print wheel in accordance with the present invention when taken in conjunction with the accompanying drawings, wherein:

FIG. 6 is a perspective view of the carriage assembly in accordance with another aspect of the present invention adapted for tiltably supporting the locking assembly therein;

FIG. 7 is a perspective view of a bias plate in accordance with the present invention adapted for biasing the carriage assembly to a position where the print wheel is arranged in a vertical orientation adjacent the advancing means to effect printing on a piece of paper;

DETAILED DESCRIPTION

Figure 1:
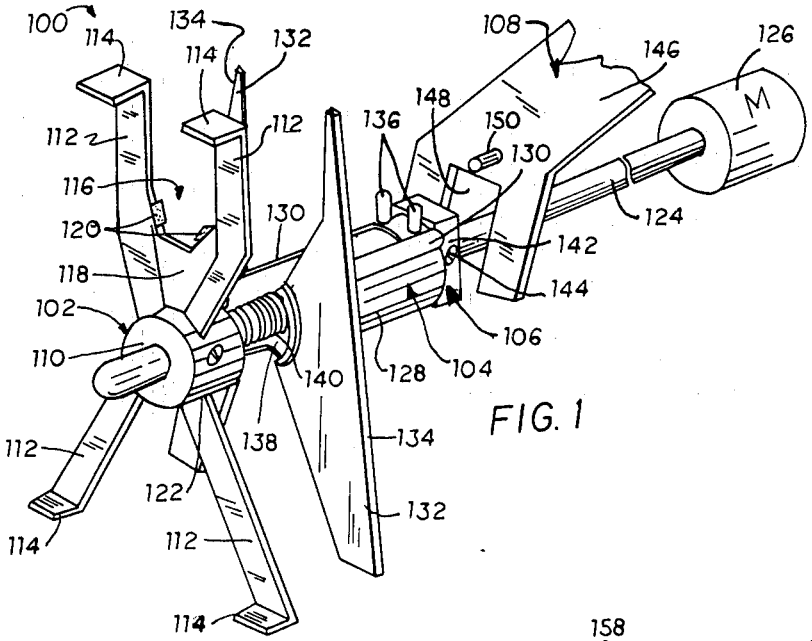
FIG. 1 is a perspective view of the locking assembly for a print wheel of the daisy type in accordance with the present invention showing a print wheel stop secured to the free end of a shaft having a print wheel retainer slidably received thereon between the print wheel stop and a print wheel collar arranged adjacent a print wheel yoke having an opening adapted to receive the print wheel collar therethrough.

Referring now generally to the drawings in which like reference characters represent like elements, there is shown in FIG. 1 a perspective view of a locking assembly 100 constructed in accordance with the present invention. The locking assembly 100 is constructed from a print wheel stop 102, a print wheel retainer 104, a print wheel collar 106 and a print wheel yoke 108. The print wheel stop 102 is constructed from a hub 110 having four radial outwardly extending arms 112 lying in a common plane normal to the longitudinal or rotational axis of the hub. A standoff 114 is provided at the terminal end of each arm 112 and arranged to extend outwardly therefrom. Formed between a pair of adjacent arms 112 is a shaped opening 116 defined by a fillet 118 and a pair of pads 120 provided on the opposite inside edges of the adjacent arms overlying the fillet. The hub 110 is provided with a set screw 122 for securing the print wheel stop 102 to the shaft 124 of a rotary drive mechanism or motor 126.

The print wheel retainer 104 is constructed of a hub 128 having a pair of longitudinally extending ribs 130 arranged on opposite circumferential sides of the hub and having a radial extent greater than the radial extent of the hub 128. A pair of wings or planar members 132 are secured to one end of the hub 128 lying in a common plane normal to the longitudinal or rotational axis of the hub 128. The lateral outwardly facing edges 134 of the wings 132 lie on a line arranged at an angle to the vertical axis of the print wheel retainer 104. In other words, the outer shape of the wings or planar members 132 when viewed from the front thereof is generally that of a truncated triangle. A pair of pins 136 are provided extending radial outwardly from the other end of the hub 128 between the ribs 130. The hub 128 is provided with a longitudinally extending bore 138 adapted to permit sliding engagement of the print wheel retainer 104 along the shaft 124, as well as to receive a bias element or spring 140 therein. The diameter of the bore is generally greater than the diameter of the hub 110 of print wheel stop 102 to receive the hub therein as to be described hereinafter.

The print wheel collar 106 is constructed generally from a rectangular block 142 having a set screw 144 for securing the collar to the shaft 124. The dimensions of the print wheel collar 106 between at least one pair of parallel side edges, that is its width or height, is no greater than the diameter of the hub 128, of the print wheel retainer 104, excluding the ribs 130. The print wheel yoke 108 is constructed from an arm 146 having an opening 148 at one end thereof. The opening 148 of the print wheel yoke 108 is of a shape and dimension, conforming to the shape and dimension of the print wheel collar 106 to allow the collar to pass through the opening when in alignment therewith as to be described hereinafter with respect to the operation of the locking assembly 100 in accordance with the present invention. A pin 150 is provided extending outwardly from the arm 146 of the print wheel collar 106 adjacent the opening 148.

The arrangement of the locking assembly 100 in accordance with the present invention will now be described. The print wheel stop 102 is secured by the set screw 122 to the free end of the shaft 124 extending from the motor 126. In this arrangement, the arms 112 are arranged in a plane normal to the longitudinal or rotational axis of the shaft 124. The print wheel retainer 104 is slidingly received along the shaft 124 behind the print wheel stop 102 such that the wings or the planar members 132 lie in a plane normal to the longitudinal or rotational axis of the shaft 124 and parallel to the plane containing the arms 112 of the print wheel stop 102. The print wheel retainer 104 is biased away from the print wheel stop 102 into a connecting position by means the bias element or spring 140. The spring 140 is positioned about the shaft 124 and captured at one end thereof within the bore 138 of the hub 128 of the print wheel retainer 104 and its other end arranged in contact with the end of the hub 110 of the print wheel stop 102. The print wheel collar 106 is secured to the shaft 124 via the set screw 144 to limit the permissible longitudinal sliding extent of the print wheel retainer 104 along the shaft by action of the bias element or spring 140. That is, the print wheel collar 106 is secured to the shaft 124 at a position where the spring 140 is slightly compressed to urge the print wheel retainer 104 away from engagement with the adjacent end of the hub 110 of the print wheel stop 102. The print wheel yoke 108 is arranged extending normal to the longitudinal or rotational axis of the shaft 124 with the shaft extending through the opening 148. The arm 146 of the print wheel yoke 108 is secured at one end thereof to an assembly, see FIG. 6, to cause movement of the arm along the longitudinal or rotational axis of the shaft 124 in a manner to be described hereinafter. The specific assembly adapted for movement of the print wheel yoke 108 can be constructed of a slide assembly or other such assembly known to those skilled in the art and accordingly will not be further described.

Figure 2A:
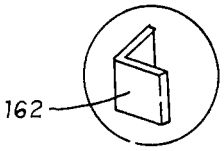
FIG. 2 is a front elevational view of a print wheel of the daisy type showing a plurality of hook-shaped shoulders arranged thereon and having a generally centrally disposed alignment or retaining member.
Figure 2:
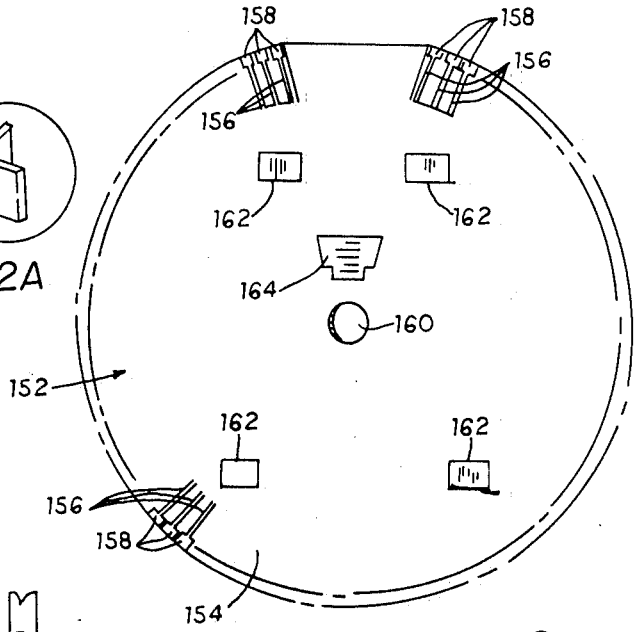

The locking assembly 100 in accordance with the present invention is adapted to releasably connect a print wheel of the daisy type thereto. One such print wheel or daisy suitable for use with the locking assembly in accordance with the present invention is shown in FIG. 2. Referring to FIG. 2, the print wheel or daisy 152 is constructed from a circular planar body 154 having a plurality of pedals or radially-extending spokes 156 which carry the various character elements 158 at the radial extremeties thereof a cicumferentially spaced positions about the print wheel. A hole 160 is provided at the center of the print wheel 152 to receive the shaft 124 therein. Positioned about the hole 160 are four hook-shaped shoulders 162 arranged in an upper pair having their respective openings facing each other and a lower pair having their respective openings facing each other. As shown, the distance between the upper pair of shoulders 162 is less than the distance between the lower pair of shoulders 162 such that a line projecting through an upper and underlying lower shoulder lies at an angle to the vertical axis of the print wheel 152. That is, the outline formed by the hook-shaped shoulders 162 is generally that of a truncated triangle conforming to the shape, size and angles of the truncated triangle formed by the wings or planar members 132 of the print wheel retainer 104. Positioned above the hole 160 is a retaining or alignment member 164 having a shape conforming to the shape of the shaped opening 116 provided between the arms 112 of the print wheel stop 102.

Figure 3:
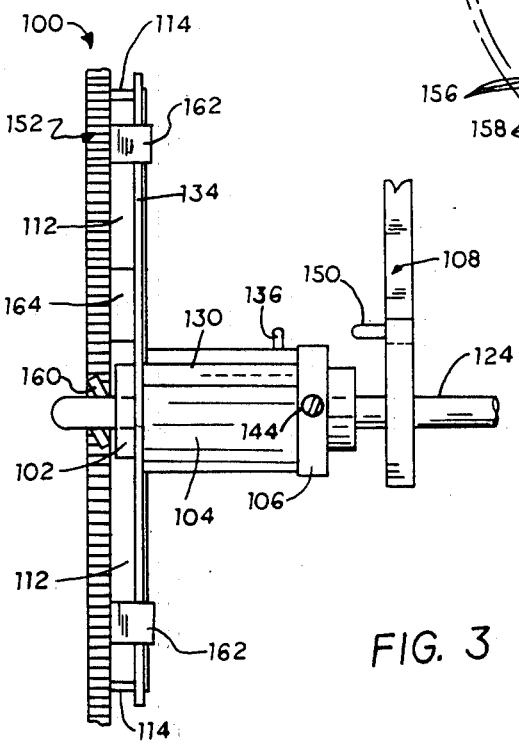
FIG. 3 is a side elevational view of the locking assembly as illustrated in FIG. 1 showing the print wheel being detachably connected thereto for rotation about its axis by a rotary drive mechanism.
Figure 4:
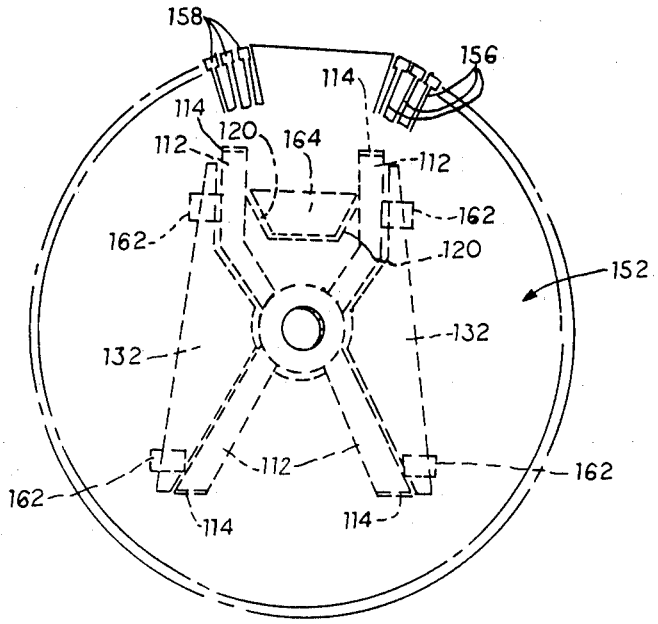
FIG. 4 is a front elevational view showing the hook-shoulders of the print wheel being engaged by the print wheel retainer and the retaining member being engaged by the print wheel stop.
Figure 5:
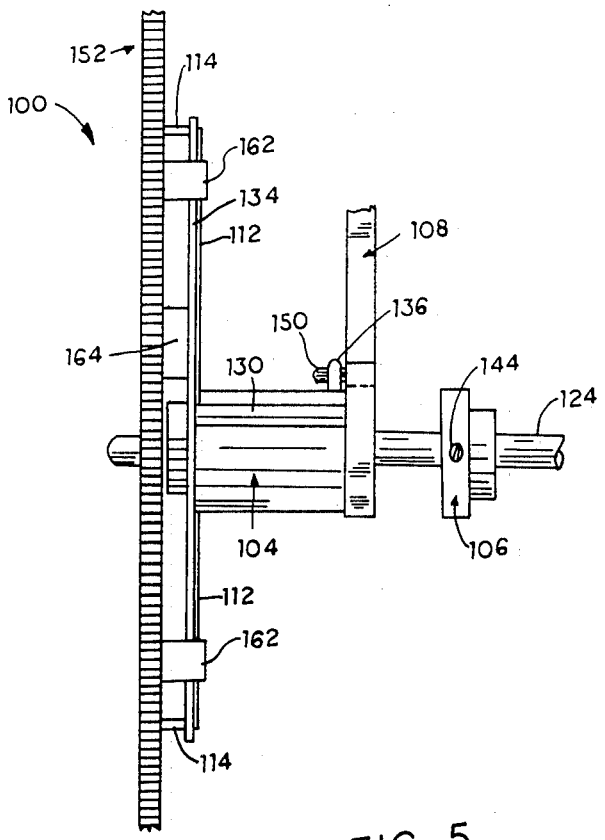
FIG. 5 is a side elevational view of the locking assembly illustrated in FIG. 1 showing the assembly arranged for removal and/or replacement of the print wheel therefrom by the print wheel yoke having engaged the print wheel retainer.

Referring now to FIGS. 3 through 5, the operation of the locking assembly in accordance with the present invention will now be described. To attach a print wheel 152 to the locking assembly 100, it is required that the print wheel retainer 104 be biased into a print wheel detaching position wherein the wings or planar members 132 are positioned adjacent the arms 112 of the print wheel stop 102 and wherein the hub 110 of the print wheel stop is generally captured within the bore 138 of the print wheel retainer. In accomplishing this arrangement, the shaft 124 of the motor 126 is rotated, e.g., by hand via the print wheel 152 until the print wheel collar 106 is in alignment with the opening 148 provided within the print wheel yoke 108. The print wheel yoke 108 is moved along the longitudinal or rotational axis of the shaft 124 such that the print wheel collar 106 passes through the opening 148 and is positioned adjacent the right side of the print wheel yoke as shown in FIG. 5. As the print wheel collar 106 passes through the opening 148, the arm 146 of the print wheel yoke engages the ribs 130 of the print wheel retainer 104. The further longitudinal movement of the print wheel yoke 108 biases the print wheel retainer 104 adjacent the print wheel stop 102 into a print wheel connecting position. In the print wheel connecting position, as shown in FIG. 5, a portion of the hub 110 of the print wheel stop 102 is received within the bore 138 of the print wheel retainer 104 such that the wings or planar members 132 of the print wheel retainer are now positioned adjacent the arms 112 of the print wheel stop. As further shown, the pin 150 extending outwardly from the print wheel yoke 108 is received between the pair of pins 136 extending upwardly from the print wheel retainer 104. In this regard, the engagement of the pin 150 between the pins 136 prevents rotation of the print wheel retainer 104 about the shaft 124 to cause misalignment thereof when attempting to attach a print wheel 152 to the locking assembly 100.

The locking assembly 100 in the print wheel connecting position is now ready to receive and secure a print wheel 152 thereto. A print wheel 152 having the upper and lower pairs of shoulders 162 arranged on a horizontal axis and facing the locking assembly 100 is now slid downward along a generally upright plane across the face of the locking assembly. As the print wheel 152 slides across the face of the locking assembly 100, the lower shoulders 162 first receive the edges 134 of the wings or planar members 132 followed by the upper shoulders 162. As the print wheel 152 is arranged in its proper orientation with respect to the locking assembly 100, the shaft 124 is positioned within the hole 160, the retaining or alignment member 164 is arranged in alignment with the shaped opening 116 formed between the upper pairs of arms 112 and all of the shoulders 162 are engaged by the edges 134 of the wings or planar members 132, as shown in FIG. 4. To firmly secure the print wheel 152 to the shaft 124 of the motor 126, the print wheel yoke 108 is returned to its original position as shown in FIG. 3. That is, the print wheel yoke 108 is longitudinally moved along the shaft 124 to allow the print wheel collar 106 to pass through the opening 148 returning the print wheel yoke to its position adjacent the left side of the print wheel collar as shown in FIG. 3, thereby disengaging the biasing of the print wheel retainer 104 by the print wheel yoke. The disengagement of the print wheel yoke 108 with the print wheel retainer 104 allows the bias element or spring 140 to urge the print wheel retainer away from the print wheel stop 102 until the hub 128 of the print wheel retainer abuts against the print wheel collar 106 as shown in FIG. 3. Thus, as the print wheel retainer 104 is biased away from the print wheel stop 102, by means of the bias element or spring 140, the engagement of the shoulders 162 about the wings or planar members 132 causes the print wheel 152 to be drawn against the standoffs 114 at the terminal ends of the arms 112. In this regard, the print wheel 152 is tightly and securely pulled against the standoffs 114 by the print wheel retainer 104 with the shaft 124 of the motor 126 extending through the hole 160 and the retaining or alignment member 164 being captured within the shaped opening 116 formed between the upper pairs of arms 112. The print wheel 152 may be removed from the locking assembly for replacement thereof by reversing the foregoing process as previously described.

Figure 8:
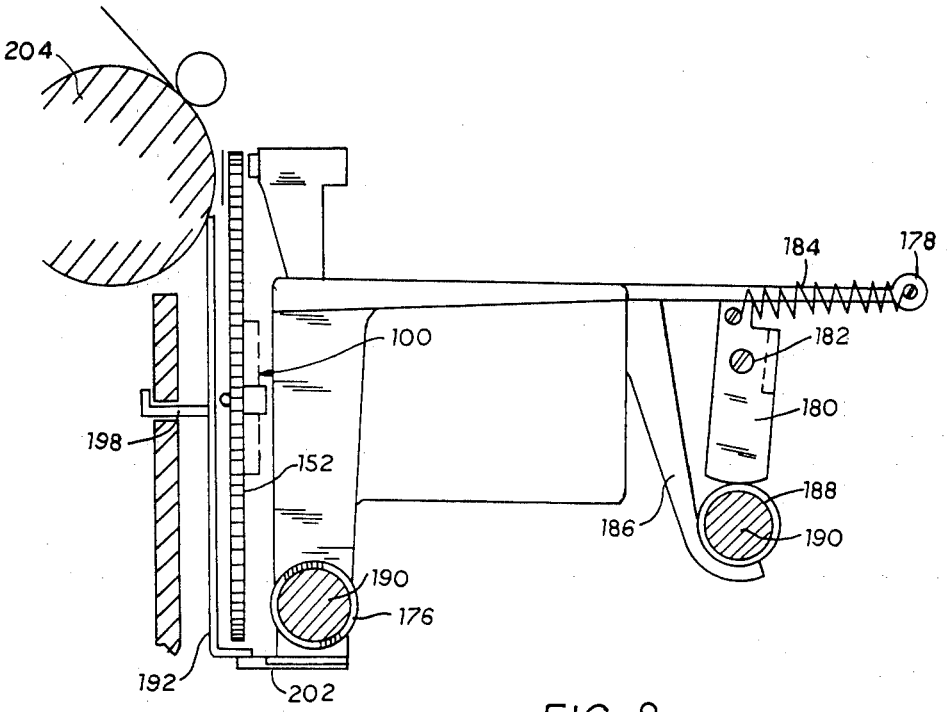
FIG. 8 is a side elevational view of the carriage assembly illustrated in FIG. 6 showing the bias plate arranged in a vertical orientation adjacent one side of the print wheel and secured to the carriage assembly; and, FIG. 9 is a side elevational view of the carriage assembly as illustrated in FIG. 6 showing the carriage assembly and print wheel tilted away from the advancing means and the bias plate adapted for biasing the carriage assembly and print wheel to its printing position adjacent the advancing means.

The attaching of a print wheel 152 to the locking assembly 100 has thus far been described by sliding the print wheel 152 downward along a generally upright plane across the face of the locking assembly to cause engagement of the shoulders 162 with the wings or planar members 132 of the print wheel retainer 104. However, to facilitate this operation and to prevent interference with the other components of the printing device, such as the paper advancing assembly or paper platen, the locking assembly may be provided in a carriage which is tiltable away from the paper platen to permit greater access to the locking assembly. Referring to FIG. 6, there is shown a carriage assembly 168 adapted to house the locking assembly 100. The carriage assembly 168 is generally constructed of a housing or support 170 having a pair of parallel spaced apart legs 172. The lower extremity of the legs 172 is provided with an opening 174 fitted with a slide bushing 176 in alignment along a common axis. The rear portion of the support 170 is constructed of an outwardly extending arm 178 having a lever 180 pivoted thereto in a vertical orientation about pivot point 182 and biased in a clockwise orientation by means of a spring 184. Secured to the support 170 and underlying the arm 178 is an L-shaped member 186. As shown in FIGS. 6 and 8, the leading curved end of the L-shaped member and the lowermost terminal end of the lever 180 are arranged opposite each other and adapted to receive and secure therebetween a slide bushing 188 of similar construction to the slide bushings 176.

The carriage assembly 168 is slidingly mounted within the printing device by means of a pair of parallel spaced rods 190. The rods 190 are arranged transversely extending across the printing device in parallel alignment with the longitudinal axis of the paper platen as shown in FIG. 8. The carriage assembly 168 can now be slid along the longitudinal axis of the paper platen by the rods 190 being slidingly received within the slide bushings 176, 188. In this manner, the carriage assembly 168 is adapted to move the print wheel 152 across the face of a piece of paper to effect printing thereon as the paper is advanced along a paper feed path by the paper advancing assembly or paper platen with the printing device.

Referring to FIG. 7, a metal bias plate 192 is constructed from a formed body 194 having a lower flange 196, a pair of gripping legs 198 arranged extending outwardly normal to the planar surface of the body 194 and a pair of openings 200 adapted to receive therein the printing ribbon for the printing device. The bias plate 192 is attached to the support 170 by securing the flange 196 to the legs 172 at the lips 202 thereof by any suitable means such as bolting and the like. As shown in FIG. 8, the bias plate is arranged in a vertical orientation extending across the opening formed between the legs 172 of the support 170 and having the gripping legs 198 projecting outwardly therefrom and into engagement with a portion of the printing device. For example, the gripping legs 198 engage a portion of the frame of the printing device underlying the paper platen 204. The print wheel 152 is positioned adjacent the bias plate 192 on the right side thereof as viewed in FIG. 8 and the paper platen 204 is positioned adjacent the left side thereof.

The operation of the carriage assembly 168 and the bias plate 192 will now be described with reference to FIGS. 8 and 9. The carriage assembly 168 in its normal operating position within the printing device is as shown in FIG. 8. In this regard, the print wheel 152 is arranged in a vertical orientation in parallel alignment with the planar face of the bias plate 192. The vertical positioning of the print wheel 152 is acheived by the engagement of the slide bushing 188 between the lever 180 and the L-shaped member 186. Specifically, the spring 184 biases the lever 180 into a clockwise rotation to engage the circumferential surface of the slide bushing 188 to the right of its vertical axis so as to secure the slide bushing into engagement with the L-shaped member 186. With the slide bushing 188 captured between the L-shaped member 186 and lever 180, the carriage assembly 168 is arranged in its operating position with the print wheel 152 arranged in a vertical orientation adjacent the bias plate 192 to effect printing on a piece of paper being advanced by the paper platen 204. The carriage assembly 168 may be slid along the rails 190 across the face of a piece of paper to effect continuous printing thereon.

Figure 9:
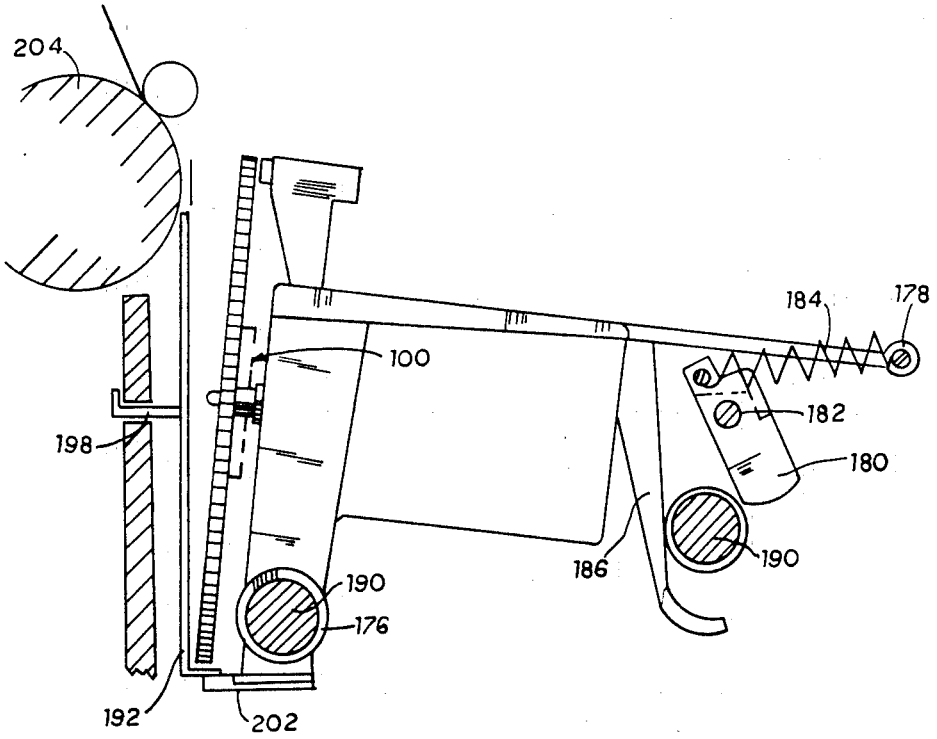

Although it is possible to remove the print wheel 152 from the carriage assembly 168 when in its operating position as shown in FIG. 8, the removal and/or replacement of the print wheel can be greatly facilitated by tilting the carriage assembly in the manner as shown in FIG. 9. As shown in FIG. 9, the carriage assembly 168 is tilted in a clockwise direction about the rod 190 extending through the legs 172 so as to tilt the print wheel 152 away from the bias plate 192 to facilitate removal and/or replacement thereof. The carriage assembly 168 is tilted downward in a clockwise direction by pressing downwardly upon the arm 178 to cause the lever 180 to rotate in a counterclockwise direction about pivot point 182 due to the circumferential engagement of the slide bushing 188 with the terminal end of the lever. As the lever 180 rotates in a counterclockwise direction, the slide bushing 188 is disengaged from between the L-shaped member 186 and the lever 180 while the carriage assembly 168 is tilted in a clockwise direction about rod 190 into the position shown in FIG. 9. The terminal end of the lever 180 which engages the circumferential surface of the slide bushing 188 may be shaped to conform to the circumferential shape of the slide bushing if desired. It can therefore be appreciated that the carriage assembly 168 can be tilted downwardly in a clockwise direction by pressing upon the arm 178, while returning the carriage assembly to its operating position by tilting upwardly in a counterclockwise direction by pulling the arm 178 upwardly in the opposite manner to that previously described. The upward lifting of the arm 178 causes the lever 180 to rotate in a clockwise direction as it follows the circumference of the slide bushing 188 so as to capture the slide bushing between the terminal end of the lever and the L-shaped member 186 as shown in FIG. 8.

Referring to FIG. 9, as the carriage assembly 168 is tilted downwardly in a clockwise direction, the bias plate 192 is maintained in its vertical orientation as shown in FIG. 8 by means of the gripping legs 198 engaging a portion of the printing device. The bias plate 192 has the operative effect of biasing or urging the carriage assembly 168 from its tilted position as shown in FIG. 9 back to its operating position as shown in FIG. 8 with the print wheel 152 arranged in a vertical orientation. This biasing effect is created by the tension induced between the bias plate 192 and the carriage assembly 168 as the carriage assembly is tilted away from the bias plate which is secured to the legs 172 thereof and to the printing device by means of the gripping legs 198. This tension is almost equal to the force which holds the carriage assembly 168 in its tilted position as shown in FIG. 9. As a result, any vibration caused by the operation of the printing device, such as the operation of one or more motors therein or the movement of the carriage assembly 168 along the rails 190 under programmed control of the printing device, causes the carriage assembly 168 to tilt upwardly in a counterclockwise direction to return the carriage assembly to its normal operation position as shown in FIG. 8 by means of the biasing force created by the bias plate 192. It can therefore be appreciated, that the bias plate 192 is operative to return the carriage assembly 168 from its tilted position as shown in FIG. 9 to its normal operating position as shown in FIG. 8 without the necessity of manually performing this operation as previously described. Thus, should one forget to return the carriage assembly 168 to its operating position after replacement of a print wheel 152, the initial operation of the printing device will automatically return the carriage assembly to its operating position without concern of the user by means of the bias plate 192 in accordance with the foregoing aspect of the present invention.

In accordance with the thus described aspect of the present invention, a carriage assembly has been described including a carriage assembly having a print wheel for use in a printing device, the printing device having advancing means for advancing a sheet of paper past the carriage assembly to effect printing thereon by the print wheel, the carriage assembly constructed of a mechanism adapted for rotationally supporting the print wheel adjacent the advancing means, the mechanism arranged within the printing device for tilting the print wheel away from the advancing means for replacement thereof and for sliding along a pair of spaced rods arranged extending across the printing device in parallel alignment with the longitudinal axis of the advancing means, and biasing means secured to the mechanism and arranged in a vertical orientation adjacent the advancing means for biasing the mechanism towards the advancing means when the print element is tilted away from the advancing means, the biasing means includes gripping means for gripping the printing device to maintain the biasing means in the vertical orientation upon tilting of the mechanism away from the advancing means, whereby the operation of the printing device causes the biasing means to return the print element to the vertical position adjacent the advancing means to effect printing on a sheet of paper.

Although the invention herein has been described with reference to particular embodiments, it is to be understood that these embodiments are merely illustrative of the principals and application of the present invention. For example, as shown in FIG. 4, the outer shape of the print wheel stop 102 may be constructed to conform to the shape of the opening defined between the wings 132 of the print wheel retainer 104. In this regard, the print wheel stop 102 may be caused to pass into such opening by operation of the print wheel yoke 108 to facilitate the attachment and detachment of the print wheel 152 to the print wheel retainer 104 by means of the shoulders 162. It is therefore to be understood that numerous modifications may be made in the illustrative embodiments and that other arrangements may be devised without departing from the spirit and scope of the present invention as defined by the appended claims.

What is claimed is:

1. A carriage assembly including a print element for use in a printing device, said printing device having advancing means for advancing a sheet of paper past said carriage assembly to effect printing thereon by said print element, said carriage assembly comprising support means for supporting said print element adjacent said advancing means, said support means arranged within said printing device for tilting said print element away from said advancing means, and biasing means in operative association with said printing device for biasing said support means towards said advancing means when said print element is tilted away from said advancing means and when said printing device is operated, to thereby cause said print element to return to a position adjacent said advancing means to effect printing on a sheet of paper, said biasing means including gripping means for gripping said printing device to maintain said biasing means in a vertical orientation upon tilting of said mechanism away from said advancing means.

2. The carriage assembly of claim 1 wherein said mechanism is adapted to slide along a pair of parallel spaced rods arranged transversely extending across said printing device in parallel alignment with the longitudinal axis of said advancing means.

3. The carriage assembly of claim 1 wherein said biasing means is secured to said mechanism and arranged in a vertical orientation adjacent said advancing means on one side thereof and adjacent said print element on the other side thereof.

4. The assembly of claim 1 wherein said biasing means engages a portion of said printing device to bias said support means towards said advancing means.

5. A carriage assembly including a print wheel for use in a printing device, said printing device having advancing means for advancing a sheet of paper past said carriage assembly to effect printing thereon by said print wheel, said carriage assembly comprising a mechanism adapted for rotationally supporting said print wheel adjacent said advancing means, said mechanism arranged within said printing device for tilting said print wheel away from said advancing means for replacement thereof and for sliding along a pair of spaced rods arranged extending across said printing device in parallel alignment with the longitudinal axis of said advancing means, and biasing means secured to said mechanism and arranged in a vertical orientation adjacent said advancing means for biasing said mechanism towards said advancing means when said print element is tilted away from said advancing means, said biasing means includes gripping means for gripping said printing device to maintain said biasing means in said vertical orientation upon tilting of said mechanism away from said advancing means, whereby the operation of said printing device causes said biasing means to return said print element to said vertical position adjacent said advancing means to effect printing on a sheet of paper.

6. A carriage assembly including a print element for use in a printing device, said printing device having advancing means for advancing a sheet of paper past said carriage assembly to effect printing thereon by said print element, said carriage assembly comprising support means for supporting said print element adjacent said advancing means, said support means arranged within said printing device for tilting said print element away from said advancing means, and biasing means in operative association with said printing device for biasing said support means towards said advancing means when said print element is tilted away from said advancing means and when said printing device is operated, to thereby cause said print element to return to a position adjacent said advancing means to effect printing on a sheet of paper, said biasing means secured to said mechanism and arranged in a vertical orientation adjacent said advancing means on one side thereof and adjacent said print element on the otherside thereof.

* * * * *